US006412137B1

(12) United States Patent
Heidari

(10) Patent No.: US 6,412,137 B1
(45) Date of Patent: Jul. 2, 2002

(54) PRESSURE SENSITIVE BRUSH

(76) Inventor: Mohammadreza Heidari, 1919 Fruitdale #F 406, San Jose, CA (US) 95128

( * ) Notice: Subject to any disclaimer, the term of this patent is extended or adjusted under 35 U.S.C. 154(b) by 0 days.

(21) Appl. No.: 09/844,811

(22) Filed: Apr. 28, 2001

(51) Int. Cl.[7] ..... A46B 9/04
(52) U.S. Cl. ..... 15/105; 15/167.1
(58) Field of Search ..... 15/105, 167.1

(56) References Cited

U.S. PATENT DOCUMENTS 2,935,755 A 5/1960 Leira
4,698,869 A * 10/1987 Mierau
4,716,614 A * 1/1988 Jones
5,184,368 A 2/1993 Holland
5,331,707 A * 7/1994 Irizarry
5,876,207 A * 3/1999 Sundius
6,018,839 A 2/2000 Fietz
6,081,957 A * 7/2000 Webb
6,330,730 B1 * 12/2001 Davies

* cited by examiner

*Primary Examiner*—Randall E. Chin
(74) *Attorney, Agent, or Firm*—Robert Samuel Smith

(57) ABSTRACT

A brush, particularly a tooth brush, having tufts of bristles inserted into the open ends of apertures, one tuft in one aperture. Each tuft is secured in the aperture by an elastic medium that permits the tuft to slide back and forth in the respective aperture. When force of brushing id applied that is greater than a critical value, the ends of the tufts contact and close a microswitch connected to an audio or visual signal, thereby alerting the user that the force of his brushing is excessive.

7 Claims, 5 Drawing Sheets

PRESSURE SENSITIVE BRUSH

FIELD OF THE INVENTION

This invention relates to brushes and particularly to a brush where force of brushing against the surface being brushed is monitored.

BACKGROUND AND INFORMATION DISCLOSURE

The act of brushing necessarily requires the application of some force by the brush against the surface being brushed. The force of the brush against surface must be great enough to accomplish the object of brushing, (e.g., removal of debris from the surface) and yet not be so great as to damage the surface being brushed. Such an application would be, for example, when paint is being scrubbed off painted wood or metal surface in a restoring operation. The requirement is to remove the paint without scratching the surface.

A very common brushing experience is the daily chore of brushing one's teeth. It has been substantiated that brushing the teeth with excessive force can cause damage to the gums in the form of recession of the gums.

A number of disclosures have appeared which address the problem of preventing application of excessive force when using a toothbrush.

For example, U.S. Pat. No. 2,82,544 to Hadidian discloses a toothbrush in which an array of groups of bristles is supported with the end of each group secured in a flexible band. The groups of bristles are supported in alignment by each group being inserted through a respective hole of an array of holes formed in an extension of the brush handle. Each group slides back and forth in its respective hole in response to varying force of the bristles against the surface being brushed.

U.S. Pat. No. 4,694,844 to Berl et al discloses a toothbrush in which the end of each tuft of an array of tufts (a tuft being group of bristles) is supported by independent resilient members.

U.S. Pat. No. 5,184,368 to Holland discloses an array of tufts supported in the head of the brush wherein the end of each tuft is supported against individual spiral springs.

While each of these devices alleviates the problem of excessive force against the brushed surface (the gums) to some extent, the tufts in each embodiment "bottom out" so that the user can still be applying excessive force without realizing it.

SUMMARY OF THE INVENTION

It is an object of this invention to provide a brush wherein the user is warned when force of the brush against a surface being brushed exceeds a critical value.

It is another object of the invention that the tufts of bristles be individually positioned with regard to the contour of the surfaces of the teeth.

This invention is directed toward a toothbrush including a plurality of tufts (groups) of bristles mounted in the head of the brush. Each tuft is individually mounted on an elastic diaphragm adjacent a microswitch which is one of an array of microswitches. Each tuft slides back and forth through an aperture of an array of apertures in the head of the toothbrush. When force exceeding a critical value is applied, the tufts will slide to where the end of the tuft will contact and close the adjacent microswitch. When the microswitch closes, an alarm signal generator, encased in the handle with a battery, is activated warning the user that he is exerting excessive force. The alarm signal alerts the user to exert less force to prevent damage to the surface being brushed. The battery, signal generator and microswitches adjacent the ends of the tufts are all enclosed in a housing that is permanently sealed at the time of assembly to prevent access of water to the circuit.

In one embodiment, the alarm is an audio signal generator, e.g., a buzzer or beeper. In another embodiment, the signal is visual, e.g., an LED.

DESCRIPTION OF A BEST MODE

Figure 1:
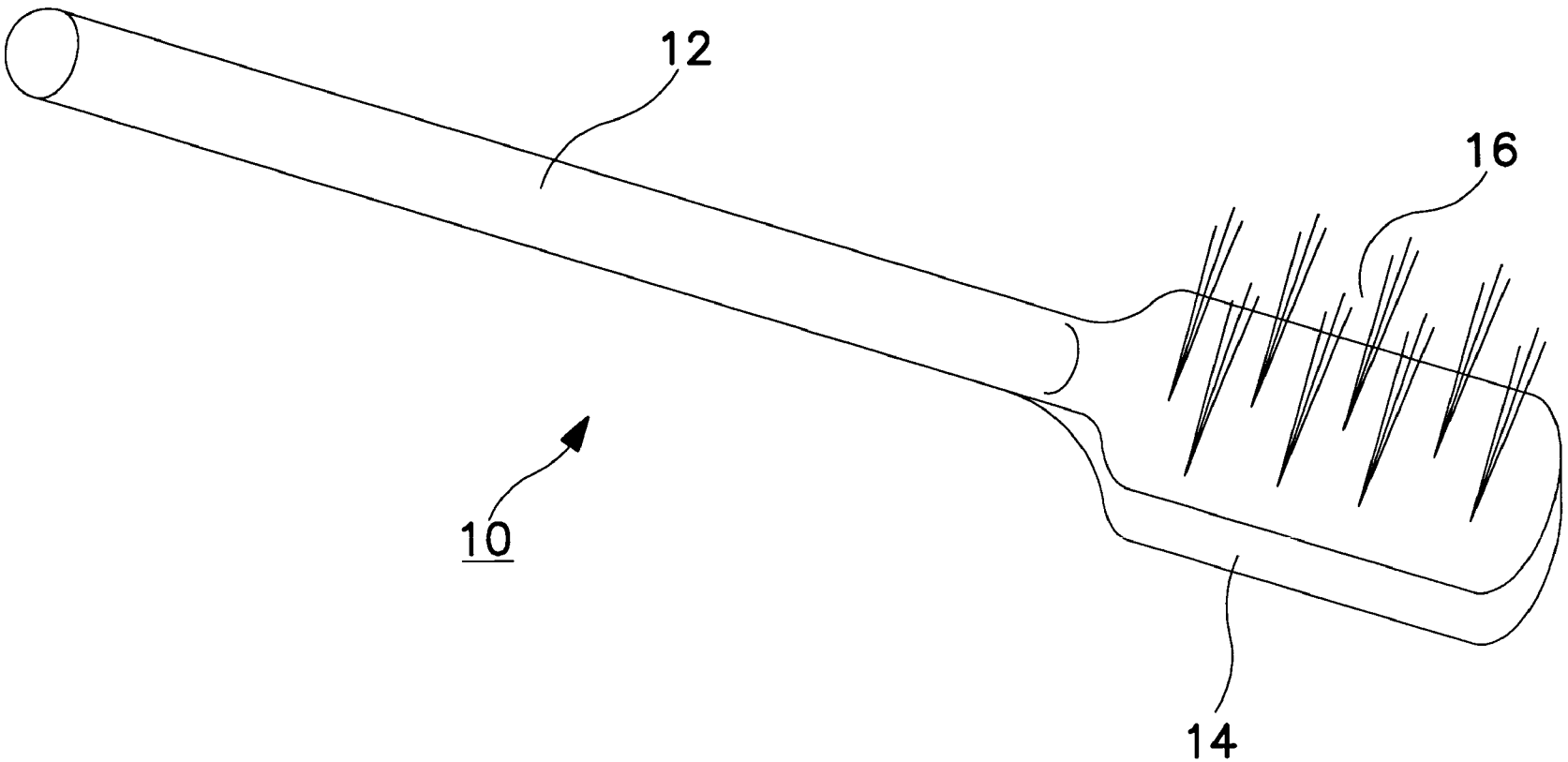
FIG. 1 shows the assembled tooth brush of this invention.

Turning now to a discussion of the drawings, FIG. 1 is an assembly view of the tooth brush 10 of this invention including a handle section 12 and a head section 14. An array of tufts 16 of bristles are mounted in the head section 14.

Figure 2A:
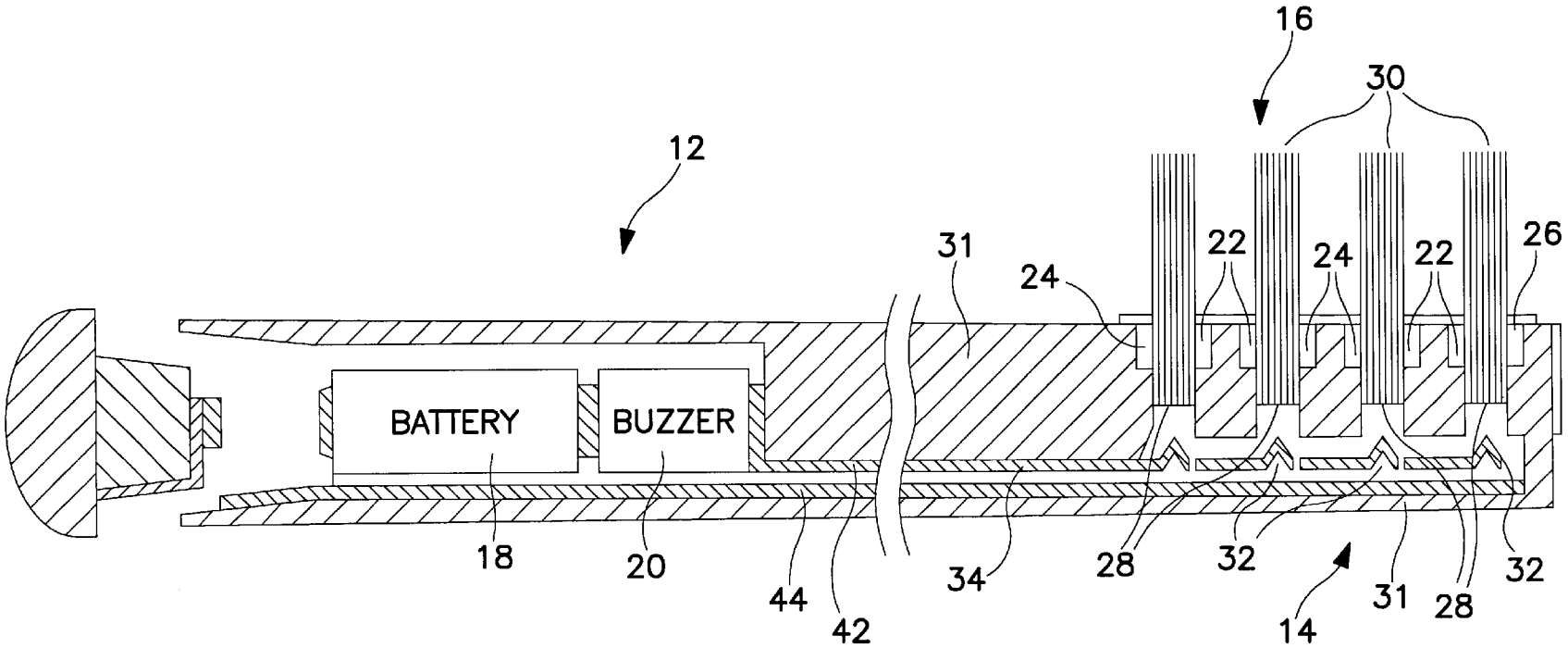
FIG. 2A is a sectional view of FIG. 1.

FIG. 2A is a sectional view of the tooth brush 10. A portion of the handle section 12 is tubular. A battery 18 connected in series with a buzzer 20 is mounted in the handle 12. A cap 11 is shown poised for mounting onto the handle 12.

Preferably, the battery and buzzer 20 are installed and the cap 11 mounted and permanently sealed at the time of assembly of the device to prevent access of moisture to the battery and signal generator 20.

Sealing the battery compartment with ap 11 relies on the fact that the life of the battery is longer than the life of the bristles so that the entire toothbrush is discarded and replacement of the battery is not practical.

FIG. 2A shows details of the mounting of the tufts. 16. The head 14 is a housing in which is formed an array of apertures 22. A captured end 28 of each tuft 16 is slideably positioned in respective aperture. 22. Each aperture 22 has a shoulder 24. An elastic diaphragm 26 is laminated to one side of the head 14 and engages each tuft 16 with one end 28 of the tuft 16 extending through the membrane 26 and almost entirely through the aperture. 22. The other end 30 of the tuft 16 is accessible for brushing the teeth.

An array of microswitches 32 is shown. Each microswitch is formed adjacent a captured end 28 of a tuft 16 on the backside of the head section 14.

Figure 2B:
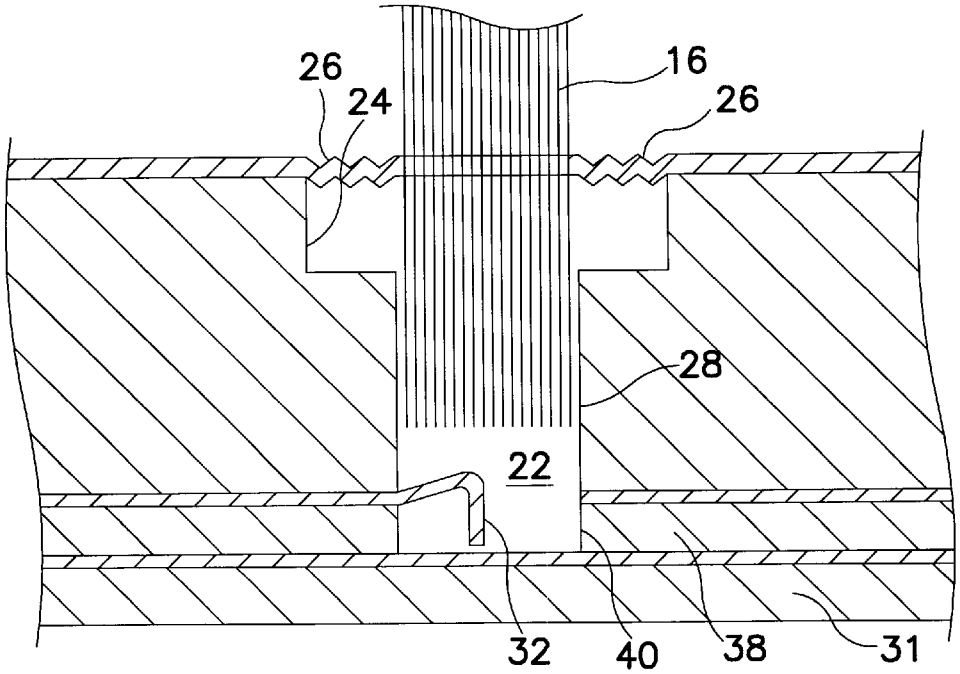
FIGS. 2B and 2C illustrate the sealing and elastic nature of the tuft support.
Figure 2C:
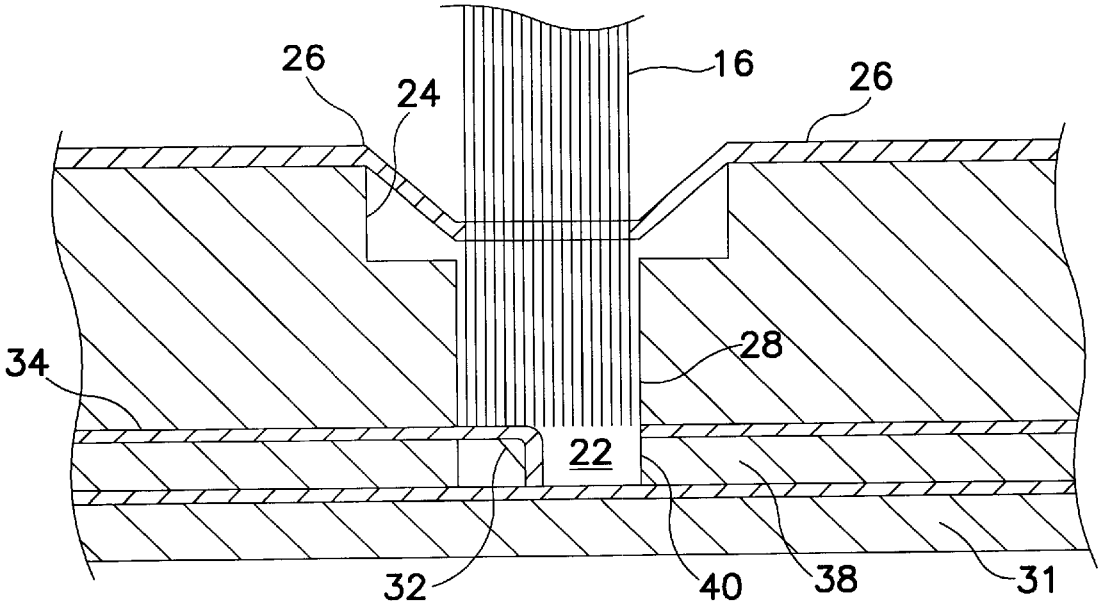

FIGS. 2B and 2C is illustrate a single tuft 16 secured by an elastic support 26 and slideably mounted in its aperture 22 adjacent a microswitch 32 showing to best advantage the oscillatory motion of a tuft sliding in the aperture 22. In FIG. 2B, the tuft is in an undisturbed state and the elastic support 26 is relaxed. In FIG. 2C, force of brushing stretches the elastic support 26 and the tuft 16 slides in its respective aperture 22 to where the end of the tuft contacts and closes the adjacent microswitch when the force of brushing is excessive. The construction illustrated in FIGS. 2A–C also demonstrate that the elastic support seals the aperture 22 to prevent moisture from penetrating through to the microswitch. 32.

Figure 3:
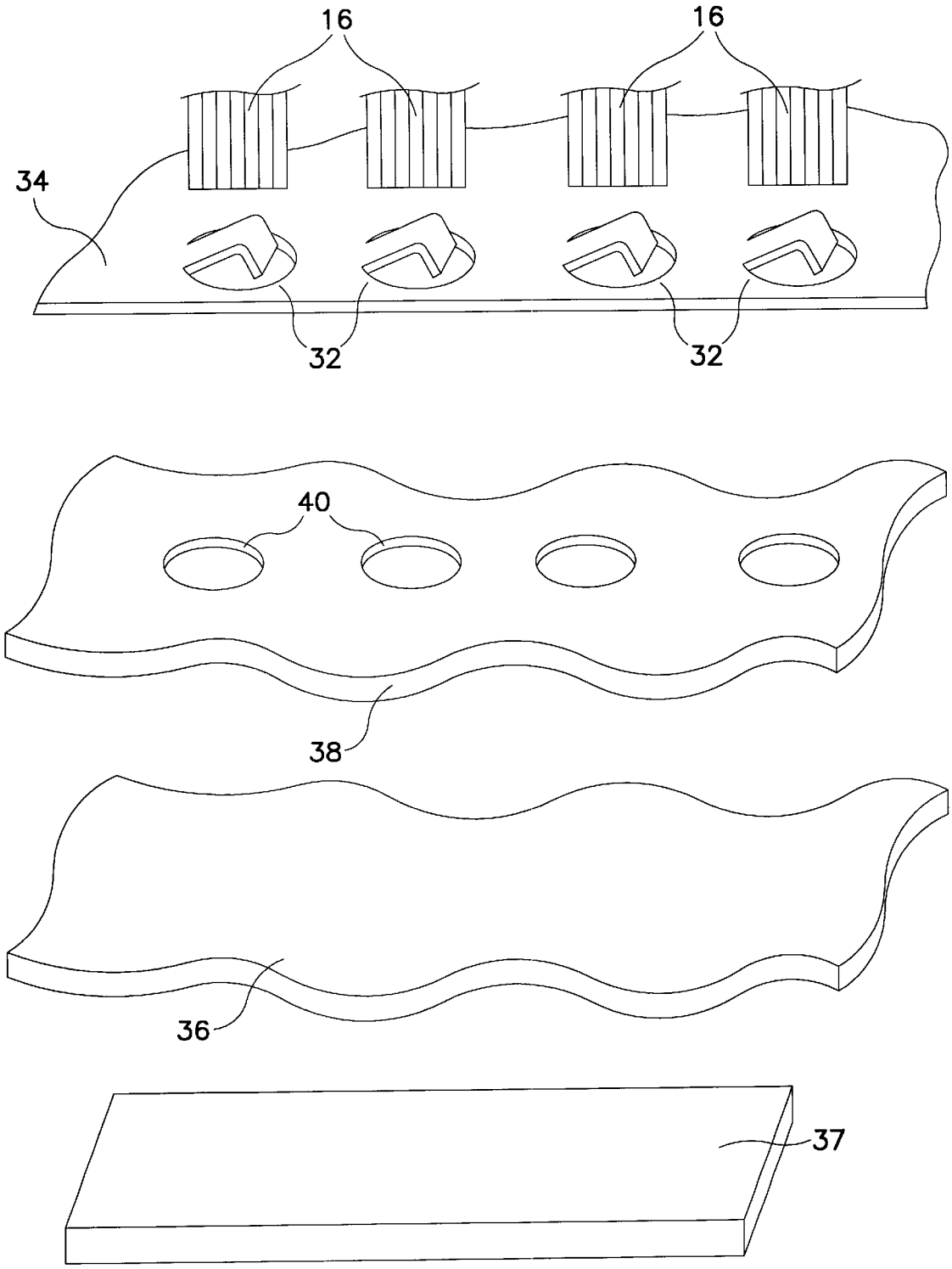
FIG. 3 is an exploded partial view showing details of the array of microswitches.

Details of the assembly of the array of microswitches 32 suggesting a method of manufacture is shown to better advantage in the cutaway view of FIG. 3. There are shown a contacter metal sheet 34 having an array of microswitches 32 and a ground metal sheet 36 separated by an insulating sheet 38.

The microswitches 32 are formed in sheet 34 preferably by a stamping process well known in the art.

The insulating sheet 38 has an array of apertures 40 aligned with the pattern of apertures 22 in the head 14 of the tooth brush 10 and the microswitches 32. Each microswitch 32 is shown as an appendage integral with contacter metal sheet 34.

The elastic sheet 26 (FIG. 2) that elastically secures the tufts in their respective apertures is a compressible elastomeric material such as urethane.

In the assembly procedure, the sheet of microswitches 34, the insulating sheet 38 the ground sheet 36 and backup panel 37 are all laminated in that order to the frame 31 of the head section 14.

As shown in FIG. 2, contactor sheet 34 and ground sheet 36 are each connected by conductors 42 and 44 respectively leading to the battery and buzzer in the handle.

The brush described and shown in FIG. 2 is amenable to construction by a molding process which forms the handle and head section with the contacter, insulator and ground sheets all encapsulated in the molding which also includes in the molding operation the formation of the array of apertures 22 and the cavity for housing the battery 18 and buzzer 20.

When the captured ends 28 of any one of the tufts 16 is forced against the adjacent microswitch 32 of the contacter sheet 34, the microswitch 32 is flexed sufficiently to make electrical contact with the ground sheet 36 thereby closing the circuit and activating the buzzer 20.

A major feature of this invention is a brushing device including a base configured for grasping by a user and a medium for brushing/scrubbing a surface and a means for generating an alarm signal when the force applied by the medium for brushing/scrubbing exceeds a critical value.

In the example presented above, the device is a toothbrush, the configuration of the base is the handle section of the toothbrush and the head of the toothbrush arranged for brushing teeth. The means for generating a signal is a microswitch at the base of each tuft connected to a buzzer and battery.

In an alternate embodiment, the signal generator is an LED.

Each tuft slides in its elastic anchorage in response to the force of brushing. When the force of brushing exceeds a critical value, a circuit is closed that activates an audio signal. An important feature of the invention is that the circuit is inherently waterproofed.

Variations and modifications of the principle features of the invention may be contemplated which are within the scope of the invention.

Figure 4:
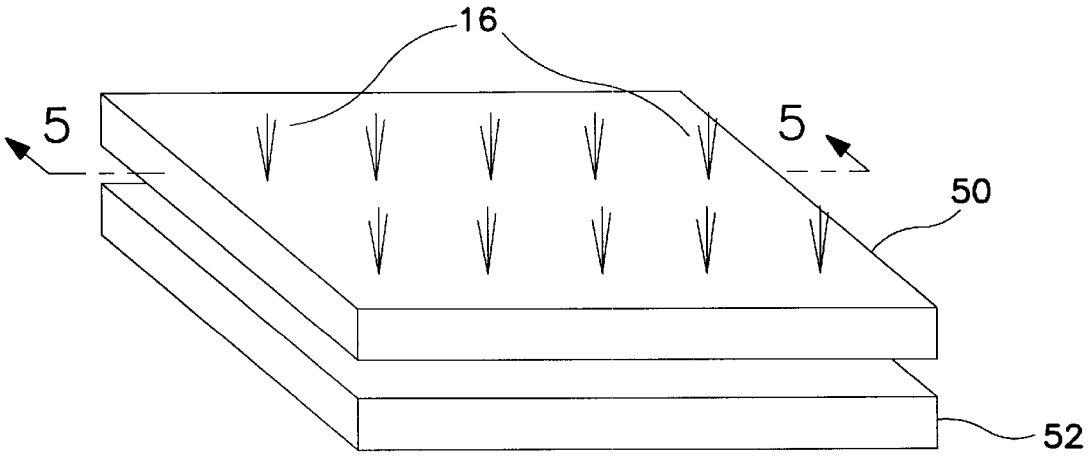
FIG. 4 shows another embodiment of the invention.
Figure 5:
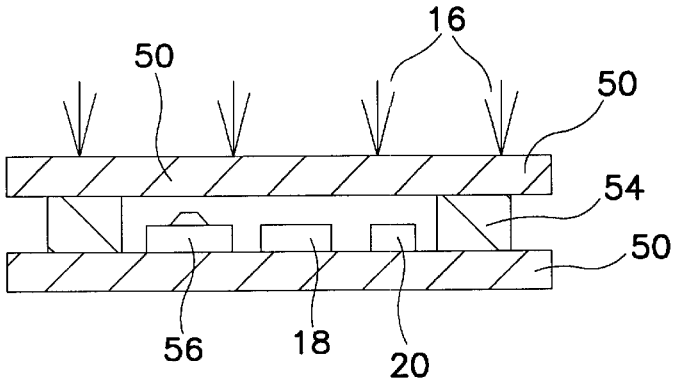
FIG. 5 shows a sectional view of FIG. 4.

For example, FIG. 4 shows an embodiment of the invention applied to a hand held brush such as would be used to clean delicate surfaces such as the surfaces of furniture. FIG. 5 is a sectional view of FIG. 4. The brush handle comprises a panel 50 having an array of tufts 16 of bristles extending from one side. The other side of the panel 50 faces and is spaced from an opposite panel 52 by a resiliently compressible spacer.54. In one embodiment, the spacer comprises springs, in another embodiment, the spacer comprises elastomeric foam. A position switch 56 is positioned in the space between the panels 50, 52 arranged to close when the panels are forced to a critical distance from one another during a brushing operation thereby activating a buzzer 20 connected in series with a battery 18.

In another embodiment, the scrubbing medium is a pad in stead of an array of bristles.

In view of these and any other variations applying the principles of the invention, I therefore wish to define the scope of my invention by the appended claims.

I claim:

1. A device for scrubbing teeth which comprises:

a base;

a plurality of tufts of bristles secured to said base;

said base including an elongated handle section and a head section extending from said handle section;

said head section having an array of apertures;

each tuft of said plurality of tufts having one end extending into one open end of one aperture of said array of apertures respectively;

a resilient medium securing each tuft in its respective aperture arranged to enable each said tuft to slide back and forth in said respective aperture in reaction to said scrubbing action; and a signal generator connectable to a battery; an array of microswitches connected in parallel to said signal generator and arranged on a panel secured to said head of said toothbrush in operable combination with a group of tufts from said plurality of tufts to provide that when any tuft of said group is subject to a scrubbing force exceeding a critical value, then an end of said any tuft is forced against an adjacent microswitch of said array of microswitches and closes said adjacent microswitch whereby said signal generator is energized that generates an alarm signal;

said alarm signal being one of a light signal and a sound signal.

2. The device of claim 1 wherein said resilient medium comprises a resilient sheet laminated to an area of said head section including said array of apertures with one of said tufts extending from each aperture through said sheet and secured to said sheet between ends of said tuft.

3. The brush of claim 1 wherein said base comprises:

a pair of panels;

resilient means for securing one panel of said pair to said other panel with each panel having one broad surface spaced from and facing said one broad surface of said other panel;

said plurality of tufts secured to a surface of said one panel opposite said other said panel whereby said panels move toward and away from one another when force of brushing is applied to brush said surface;

said signal generator comprises:

a switch means between said panels operably arranged to close when said force of brushing exceeds a critical value;

said signal generator and switch means connectable in series with said battery providing that when excessive pressure is applied to said base, said switch means closes causing said generator to generate said alarm signal.

4. A device for scrubbing a surface which comprises:

a base;

an array of tufts of bristles secured to said base;

said base operably configured to enable a user to grasp said device and scrub said surface;

an alarm means for generating an alarm signal when a critical force is exerted by said scrub medium against said surface.

said base has an array of holes;

each hole having a closed end and an open end on a surface of said base;

resilient means for securing each tuft slideably extending into said open end of a respective one of said holes;

said alarm means comprising a plurality of microswitches, each said microswitch located at said closed end of a respective hole adjacent an end of said respective tuft providing that when a scrubbing force applied to a tuft exceeds a critical value, said microswitch is closed whereby a signal generator connected to said microswitch is energized.

5. The device of claim 4 wherein said alarm means is a sound generator.

6. The device of claim 4 wherein said alarm means is a light generator.

7. The device of claim 4 wherein said alarm means is waterproofed to prevent moisture from contacting said alarm means.

* * * * *